United States Patent [19]

Kasamatsu

[11] Patent Number: 4,540,970

[45] Date of Patent: Sep. 10, 1985

[54] CIRCUIT BREAKING ELEMENT

[76] Inventor: Mikizo Kasamatsu, No. 22-7, Kōrikitano-chōNeyagawa-shi, Osaka-fu, Japan

[21] Appl. No.: 584,934

[22] Filed: Feb. 29, 1984

[30] Foreign Application Priority Data

Dec. 29, 1982 [JP] Japan ..... 57-234362
Mar. 4, 1983 [JP] Japan ..... 58-36443

[51] Int. Cl.[3] ..... H01H 85/04
[52] U.S. Cl. ..... 337/297; 337/296
[58] Field of Search ..... 337/297, 296, 166

[56] References Cited

U.S. PATENT DOCUMENTS 4,031,497 6/1977 Ozawa ..... 337/297
4,246,563 1/1981 Noerholm ..... 337/296

*Primary Examiner*—Harold Broome
*Attorney, Agent, or Firm*—Larson and Taylor

[57] ABSTRACT

A circuit breaking element comprising an electrically insulating base member, an organic insulation layer having a low melting point and formed over the surface of the base member, and a metal resistance coating layer formed over the surface of the insulation layer. When the metal resistance coating layer is thermally broken by excessive current passing therethrough, the coating layer completely separates into two portions at opposite sides of the break to completely break a circuit.

3 Claims, 6 Drawing Figures

CIRCUIT BREAKING ELEMENT

BACKGROUND OF THE INVENTION

The present invention relates to a circuit breaking element, and more particularly to improvements in circuit breaking elements of the super-small type for use in electric circuits of electric devices.

Such circuit breaking elements usually comprise an electrically insulating base member of ceramic or the like and a resistance coating layer of copper, copper alloy or some other metal directly formed over the surface of the base member by plating or vacuum evaporation. These conventional elements have the serious drawback of failing to assure safety because even if excessive current passes through the element to melt the resistance coating, the circuit will not be broken completely.

This drawback is attributable to the structure wherein the metal resistance coating layer formed by plating, vacuum evaporation or like method has a small thickness and is formed over the surface of the insulating base member. With this structure, the space formed by the melting of the metal coating with excessive current is very small, invariably permitting residual resistance to remain and failing to completely break the circuit. Thus the element is unable to perform the important function of breaking the circuit by melting. Table 1 shows the relationship between the breaking current value, the breaking time and the insulation resistance determined by a circuit breaking test with use of an element comprising a ceramic base member and a copper plating layer formed over the base member.

TABLE 1

| Breaking current value (A) | Breaking time (sec.) | Insulation resistance (MΩ) |
|---|---|---|
| 18 | 0.012 | 0.15 |
| 15 | 0.047 | 0.25 |
| " | 0.137 | 0.25 |
| 10 | 0.568 | 0.1 |
| " | 0.706 | 0.3 |
| " | 0.576 | 0.6 |
| " | 0.340 | 0.5 |
| 8 | 4.31 | 0.01 |
| " | 0.81 | 0.3 |
| " | 0.756 | 0.1 |
| 6 | 5.24 | 0.3 |
| " | 1.93 | 0.1 |
| 5 | 216.37 | 0.3 |
| " | 272.58 | 0.3 |

The table reveals that with the circuit breaking element wherein a metal resistance coating layer is formed directly over the surface of a base member, the insulation resistance is small but the residual resistance is great when the metal coating breaks on melting.

SUMMARY OF THE INVENTION

The present invention relates to improvements in the foregoing circuit breaking element.

The main object of the present invention is to provide a circuit breaking element of the type described wherein when the metal resistance coating layer is thermally broken by excessive current passing therethrough, the coating layer completely separates into opposite portions at the break to completely break the circuit, the element thus assuring safety with greatly improved reliability.

Another object of the invention is to provide a circuit breaking element which can be given the desired breaking characteristics properly and easily in accordance with the rated current value.

The present invention provides a circuit breaking element which is characterized in that the element comprises an electrically insulating base member, an organic insulation layer having a low melting point and formed over the surface of the base member, and a metal resistance coating layer formed over the surface of the insulation layer.

The circuit breaking element of the invention having the foregoing structure has the following advantage because the organic insulation layer of low melting point is interposed between the electrically insulating base member and the metal resistance coating layer.

When excessive current passes through the element, the metal resistance coating layer first develops heat, which progressively raises the temperature especially at an intermediate portion thereof, heating the organic insulation layer of low melting point beneath this portion and breaking the insulation layer at an intermediate portion thereof by melting. The metal resistance coating layer further continues to develop heat and starts melting along the break in the insulation layer. At this time, the metal resistance coating layer bridges the break, so that the bridge portion eventually breaks when heated to a higher temperature and melted. Owing to the presence of the break in the organic insulation layer, the coating layer is completely separated into two portions on opposite sides of the break to completely break the circuit. Thus, the element assures safety with greatly improved reliability.

DESCRIPTION OF THE PREFERRED EMBODIMENTS

Figure 1:
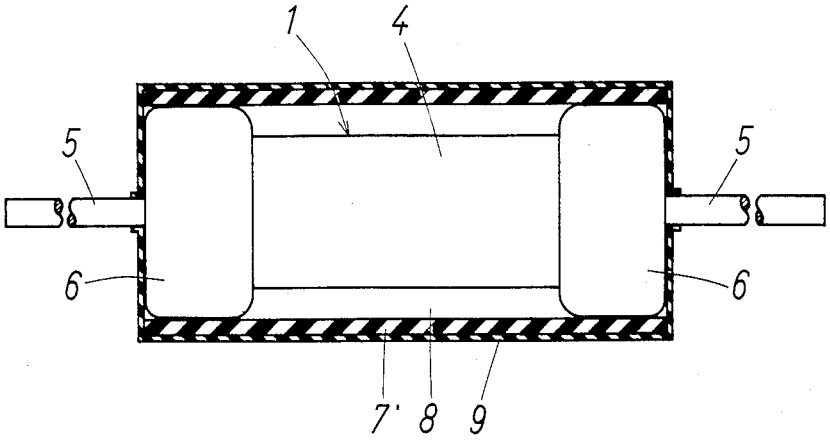
FIG. 1 is a front view partly in longitudinal section and showing a circuit breaking element of the present invention embodied as a fuse.
Figure 2:
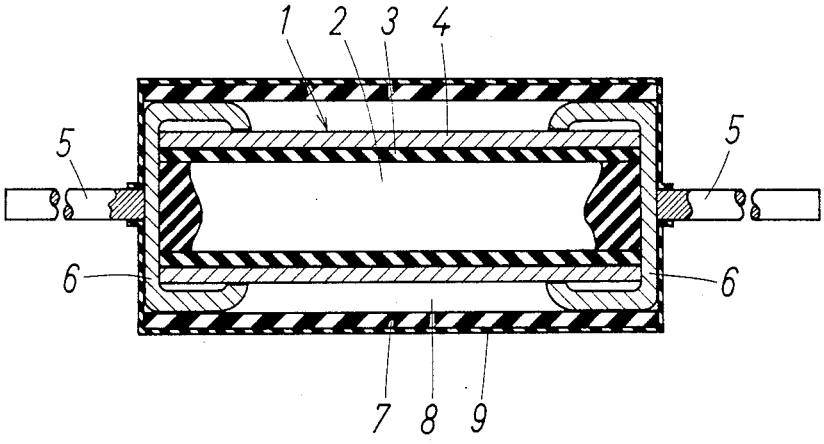
FIG. 2 is a front view showing the same in longitudinal section in its entirety.

A circuit breaking element 1 of the present invention comprises an electrically insulating base member 2 in the form of a fine wire of ceramic, an organic insulation layer 3 having a low melting point and formed over the entire surface of the base member 2 from a urethane resin by coating, and a thin metal resistance coating layer 4 made of copper and formed over the entire surface of the insulation layer by plating or vacuum evaporation.

Electrically conductive caps 6 each connected to a lead wire 5 are fixedly fitted over opposite ends of the circuit breaking element thus constructed to electrically interconnect the lead wires 5 by the metal resistance coating layer 4. The resulting assembly is fixedly enclosed in a tubular electrically insulating cover 7 of ceramic, with a clearance 8 formed between the coating layer 4 and the cover 7. The element serves as a fuse of the super-small type. Indicated at 9 is a coating of epoxy resin or the like formed over the cover 7.

The circuit breaking element 1 having the above structure and serving as a fuse completely breaks a circuit in the following manner (see FIGS. 3 (A), (B) and (C)).

(1) First, excessive current flowing through the element 1 causes the metal resistance coating layer 4 to develop heat, which progressively raises the temperature especially at an intermediate portion thereof.

Figure 3A:
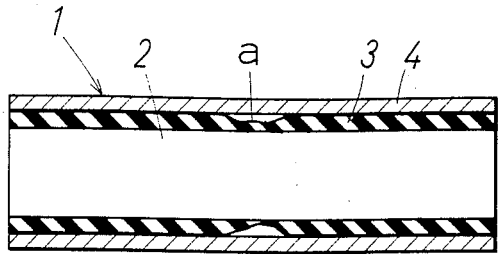
FIG. 3 (A), (B) and (C) are views illustrating how a metal resistance coating layer breaks on heating.
Figure 3B:
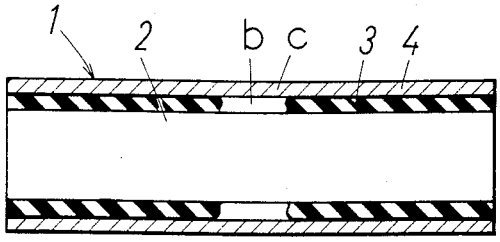
Figure 3C:
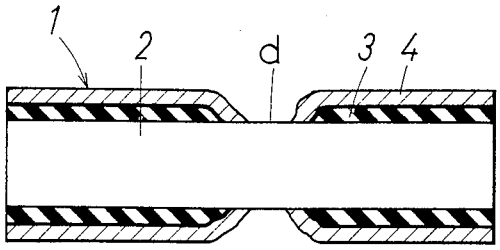

(2) When the temperature of the resistance coating layer 4 rises to the melting temperature of the underlying organic insulation layer 3 having a low melting point, an intermediate portion of the layer 3 starts to melt to form a molten portion a as shown in FIG. 3 (A).

(3) As the portion a of the organic insulating layer 3 further melts to form a complete break b at this portion as seen in FIG. 3 (B), the metal resistance coating layer 4 starts melting along the break b while bridging the break b as indicated at c.

(4) When the coating layer 4 progressively melts with a further rise of temperature, the coating layer 4 eventually breaks at the bridge portion c and completely separates into two portions at opposite sides of the break b owing to the presence of the break b in the insulation layer 3, whereby a complete break d is formed as shown in FIG. 3 (C).

Table 2 shows the relationship between the breaking current value, the breaking time and the insulation resistance determined by a circuit breaking test with use of samples according to the present embodiment 1 which is adapted to completely break a circuit in the presence of excessive current.

TABLE 2

| Breaking current value (A) | Breaking time (sec.) | Insulation resistance (MΩ) |
|---|---|---|
| 20 | 0.012 | At least 100 |
| " | 0.016 | " |
| 15 | 0.123 | " |
| " | 0.113 | " |
| 10 | 1.46 | " |
| " | 1.28 | " |
| " | 1.30 | " |
| 8 | 4.9 | " |
| " | 4.9 | " |
| 8 | 5.4 | " |
| " | 5.6 | " |
| 6.4 | 23.1 | 10.00 |
| " | 24.3 | 8.00 |
| " | 39.4 | 10.00 |

Table 2 reveals that with the circuit breaking element, i.e. fuse, embodying the invention, the insulation resistance is great with no residual resistance when the metal coating breaks on melting, indicating a complete break of the circuit.

The tubular electrically insulating cover 7 of ceramic fixedly covering the present element not only protects the metal resistance coating layer 4 from damage but also serves to completely insulate the element from other articles electrically and to prevent the melt from staining other articles. The clearance 8 formed between the resistance coating layer 4 and the cover 7 according to the present embodiment assures smooth release of heat during melting and breaking.

The materials for the electrically insulating base, the organic insulation layer of low melting point, the metal resistance coating layer and the cover are not limited to those described with reference to the above embodiment.

Examples of other useful materials are as follows.

Electrically insulating base member:

Epoxy resin, phenolic resin, polyamide resin, glass, enamel, etc.

Low-melting organic insulation layer:

Polyester resin, epoxy resin, etc.

Metal resistance coating layer:

Copper-manganese alloy, copper-nickel alloy and other copper alloys, silver, gold, etc.

Electrically insulating cover:

Epoxy resin, phenolic resin, polyamide resin, glass, enamel, etc.

Figure 4:
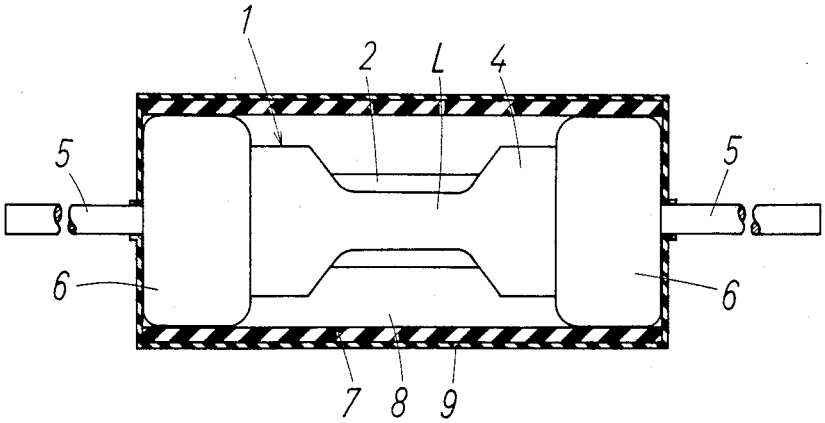
FIG. 4 is a front view partly in longitudinal section and showing another embodiment of the invention as a fuse.

While the base member is covered over the entire surface thereof with the covering of the metal resistance coating and the organic insulation according to the embodiment shown in FIG. 1, the covering shown in FIG. 4 has an intermediate portion L in the form of a wire of required width and length to partly cover the base member. One of these two modes of covering is usable selectively as desired. When a fuse of low rated current value is required, the partial covering shown in FIG. 4 is suited. A fuse having breaking characteristics in conformity with the desired rated current can be obtained by suitably determining the length and width of the portion L. The rated current value increases with an increase in the width of the portion L and decreases with an increase in the length of the portion L.

The base member can be in the form of a wire, solid cylinder, plate, chip tube or the like.

The main embodiments described above are given for illustrative purposes only and are in no way limitative. Various alterations and modifications are included within the scope of the invention insofar as they do not depart from the scope of the invention as defined in the claims.

What is claimed is:

1. A fuse comprising a circuit breaking element comprising an electrically insulating tubular base member, an organic insulation layer having a low melting point and formed over the surface of the tubular base member, and a metal resistance coating layer formed over the surface of the insulation layer, electrically conductive caps each connected to a lead wire fixedly fitted over opposite ends of said circuit breaking element so as to contact said metal resistance coating layer and electrically interconnect it to the lead wires, the resulting assembly being fixedly enclosed in an electrically insulating cover so that a clearance is formed between the cover and the metal resistance coating layer of said circuit breaking element.

2. A fuse as defined in claim 1 wherein the organic insulation layer of low melting point is formed over the entire surface of the electrically insulating base member.

3. A fuse as defined in claim 1 wherein the organic insulation layer of low melting point is partly formed on the surface of the electrically insulating base member.

* * * * *